United States Patent [19]

Pearce

[11] Patent Number: 4,912,840

[45] Date of Patent: Apr. 3, 1990

[54] MEASUREMENT APPARATUS FOR USE WITH A CONNECTOR ASSEMBLY APPARATUS

[75] Inventor: Howard R. Pearce, London, England

[73] Assignee: Thomas & Betts Corporation, Bridgewater, N.J.

[21] Appl. No.: 913,171

[22] Filed: Sep. 29, 1986

[30] Foreign Application Priority Data

Oct. 4, 1985 [GB] United Kingdom ..... 8524485

[51] Int. Cl.[4] ..... H01R 43/04

[52] U.S. Cl. ..... 29/749; 29/753; 29/759

[58] Field of Search ..... 29/333, 563, 749, 721, 29/753, 754, 759

[56] References Cited

U.S. PATENT DOCUMENTS

| | | | |
|---|---|---|---|
| 422,569 | 3/1890 | Canedy | 408/137 X |
| 2,613,432 | 10/1952 | Gilbert | 29/748 |
| 3,264,860 | 8/1966 | Herb | 72/457 |
| 3,292,236 | 12/1966 | Busler et al. | 29/33.5 |
| 4,020,540 | 5/1977 | Casciotti et al. | 29/749 |
| 4,043,017 | 8/1977 | Folk et al. | 29/749 |
| 4,148,130 | 4/1979 | Stauffer et al. | 29/749 X |
| 4,245,387 | 1/1981 | Reidt | 29/749 |
| 4,332,083 | 6/1982 | Johnson, Jr. et al. | 29/749 |
| 4,361,942 | 12/1982 | Mazzola et al. | 29/33 M |
| 4,393,580 | 7/1983 | Hall, Jr. | 29/749 |
| 4,481,710 | 11/1984 | Caveney et al. | 29/749 |
| 4,488,353 | 12/1984 | Caveney et al. | 29/749 |
| 4,517,718 | 5/1985 | Johnson, Jr. | 29/33 M |
| 4,525,927 | 7/1985 | Guerout et al. | 29/861 |
| 4,549,343 | 10/1985 | Grubb et al. | 29/33 M |
| 4,554,733 | 11/1985 | Caveney | 29/749 |
| 4,570,326 | 2/1986 | Meyer et al. | 29/749 X |
| 4,616,396 | 10/1986 | Matsui | 29/566.1 |
| 4,841,631 | 6/1969 | Selby | 29/749 |

FOREIGN PATENT DOCUMENTS

| | | | |
|---|---|---|---|
| 167620 | 6/1954 | Australia | 58.1/3.2 |
| 8303033 | 9/1983 | European Pat. Off. . | |

OTHER PUBLICATIONS

Panduit "LAT-CON TM System", Bulletin LAT-CO-N-1, Copyright 1983, 8 pages.

*Primary Examiner*—Z. R. Bilinsky

*Attorney, Agent, or Firm*—Robert M. Rodrick; Salvatore J. Abruzzese

[57] ABSTRACT

Measurement apparatus for use in connection with a connector assembly apparatus, for accurately positioning a connector on a cable relative to a previously mounted connector, the apparatus comprising a slotted plate mounted perpendicularly with respect to a base member and being adapted for displacement relative to a connector assembly station, the slot being sized to receive the cable but having a depth less than that of the mounted connector so that the cable can pass freely through the slot until the cable is positioned to abut the slotted plate. A cable having a connector prepositioned at one end thereof is positioned within the slotted plates and drawn therethrough so that the connector is urged against the plate to lock the cable in the desired position.

3 Claims, 1 Drawing Sheet

MEASUREMENT APPARATUS FOR USE WITH A CONNECTOR ASSEMBLY APPARATUS

FIELD OF THE INVENTION

This invention relates to measurement apparatus for use in connection with connector assembly apparatus. In particular the invention relates to such measurement apparatus for use in accurately positioning a connector on a cable relative to a previously mounted connector. The apparatus is particularly suitable for use with automatic or semi-automatic connector assembly apparatus for connecting two-part plug and socket connectors to a multiple core strip cable.

BACKGROUND OF THE INVENTION

Existing manual or semi-automatic cable connecting equipment relies upon a cable having been previously accurately cut to a desired length in a separate operation prior to the installation of any connectors or contacts to that cable. This necessarily requires a two stage operation for fixing connectors to a cable and is time consuming and prone to inaccuracies. In particular if, as is frequently the case, connectors are to be positioned accurately along the length of the cable and at cut ends thereof, the accurate positioning of the precut cable length relative to the connector assembly apparatus is difficult to achieve reliably and repeatably.

SUMMARY OF THE INVENTION

It is an object of the present invention to provide measurement apparatus for at least mitigating the problems associated with prior art apparatus.

Accordingly, in one aspect, the invention provides measurement apparatus for use in connection with a connector assembly apparatus, for accurately positioning a connector on a cable relative to a previously mounted connector, the apparatus comprising a slotted plate mounted perpendicularly with respect to a base member and being adapted for displacement relative to a connector assembly station, the slot being sized to receive the cable but having a depth less than that of the mounted connector so that the cable can pass freely through the slot until the cable is positioned to abut the slotted plate.

In order that the invention may be more readily understood, and so that further features thereof may be appreciated, one embodiment of the measurement means of the invention will now be described, by way of example, with reference to the accompanying drawings.

DETAILED DESCRIPTION OF THE PREFERRED EMBODIMENTS

Figure 1:
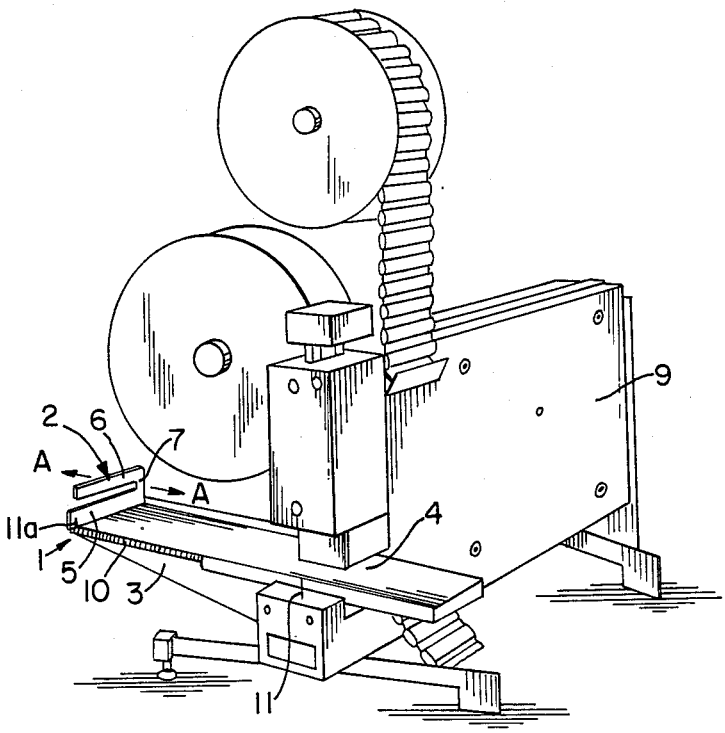
FIG. 1 is a schematic perspective view of a measurement apparatus of the invention mounted in connection with a connector assembly apparatus.

Referring to FIG. 1, measurement apparatus generally indicated 1 comprises a slot plate 2 mounted transversely on a base member 3. The slotted plate 2 is mounted substantially perpendicular with respect to the base member 3, is adapted for adjustable positioning along the length of the base member 3 and is movable in either direction as indicated by the arrows A.

Any convenient means for mounting the slotted plate 2 for movement along the base member 3 may be employed, for example the plate may be provided with a key (not shown) projecting downwardly therefrom to run in a keyway provided in the surface of the base member 3. In such arrangement suitable means would be provided for locking the slotted plate in a selected position along the length of the base member 3.

The slotted plate 2 comprises a pair of spaced apart parallel arms 5, 6 connected at one end by cross member 7 to define an open ended slot 8 between the spaced apart arms. Conveniently the upper arm 6 is slightly shorter in length than the lower arm 5, and is shaped to provide a convenient lead into the slot 8. The shaping facilitates the transverse insertion of a cable into the slotted plate as will be explained further below.

The base member 3 conveniently comprises a substantially rectangular plate that is adapted for cooperation with a connector assembly apparatus 9 and to extend transversely of the connector assembly station 4 of the apparatus 9. Although it is not shown in the drawings, the base member 3 may conveniently have a rectangular opening therein in the region of the connector assembly station 4 to allow uninterrupted functioning of the connector assembly apparatus, or may be formed as an integral part of that apparatus.

The base member 3 is marked along at least one side with a graduated scale to give a visual indication of the spacing of the slotted plate 2 from an indexing reference point 11 in the connector assembly station 4. The lower arm 5 of the slotted plate 2 is conveniently also provided with an index mark 11*a* to facilitate accurate positioning thereof.

The measuring apparatus is intended for use with connector assembly apparatus where the normal method of operation is capable of leaving one connector, or contact, installed at the free end of a reel or coil of cable prior to that cable (or wire) being cut to any desired length. The thus installed connector is then used to establish a datum for further measuring of the length of the cable for the positioning of further connectors and for the final cutting of the cable to the desired length. Such cable cutter may be an integral part of the connector assembly apparatus or may be provided separately for cooperation with the base member 3.

Figure 2:
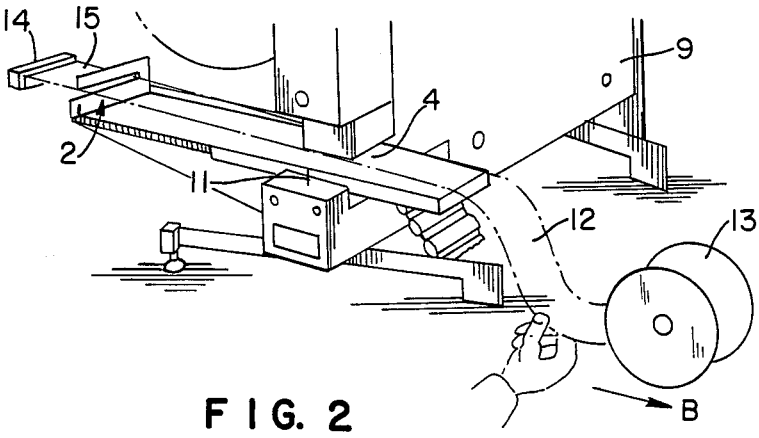
FIG. 2 illustrates the use of the measurement apparatus of FIG. 1 in positioning a cable relative to the connector assembly apparatus.

Referring now to FIG. 2, one method of operation of the measurement apparatus, in which the cable is moved manually with respect to the connector assembly apparatus, is illustrated. In FIG. 2 a length of ribbon cable 12 extending from a cable drum or reel 13 is shown with a connector 14 mounted at the outer end 15 thereof. The connector assembly apparatus 9 achieves this by first positioning the cable at an arbitrary position within the connector assembly station, cutting the cable and affixing a connector 14 to the now outer end of the cable 12. A short length of unwanted cable is necessarily generated by this operation and is discarded. Preferably, the connector 14 is a two-part multiple plug and socket connector and the cable 12 is in the form of a multicore ribbon or strip cable. It will be appreciated that the invention may equally readily be employed in connection with the mounting of single socket connector to a single core cable.

The free end 15 of the reel of cable, with a connector 14 installed thereon, is then moved outwardly from the connector assembly station 4 so that the length of cable between the outer end 15 and the connector assembly station 4 exceeds the desired length for positioning the next connector in sequence. The slotted plate 2 is then adjusted to its desired position, the distance between the slotted plate 2 and the index mark 11 in the connector assembly station 4 is the desired length for positioning of the next assembly, or for cutting of the cable. The cable is then fed transversely into the slot 8 as indicated in FIG. 2, the shaping of the upper arm 5 acting to guide the cable into position and to hold the cable within the slotted plate, with the connector 14 being positioned outwardly of the slotted plate 2, relative to the connector assembly station 4. The cable is then supported and pulled in the direction of the arrow B to move the connector 14 into a position of abutment against the slotted plate 2. The cooperation of the connector 14 and the slotted plate 2 act to lock the cable 12 in the desirably selected position for installation of a further connector.

The cable 12 may be held locked in the desired position by the maintenance of tension in the direction of arrow B or, alternatively, means may be provided for locking the cable 12 against the slotted plate 2 and for locking the cable 12 in position on the base member 3.

The assembly apparatus 9 can be activated in cycle to position a number of connectors 14 in sequence to the cable 12 or the ribbon cable may be cut to the desired length with the desired number of connectors in position.

The base member 3 may be fitted with more than one slotted plate, each slotted plate having a selected slot configuration, and, optional connector guidance means, being located at selected positions along the base member 3, an at selected orientations relative thereto, for facilitating the use of the measurement apparatus for positioning connectors at a variety of pre-set cable lengths for differing connector types and with minimum need for resetting of the apparatus. In addition, the base member 3 may include blade means for cutting the cable subsequent to the positioning of the connectors to the cable.

It is envisaged that the slotted plate may be power driven for positioning relative to the base member 3 in order to increase the automatic capability of the apparatus, such power driving optionally being used to draw cable automatically from a fixed cable drum 13. In this case it may also be desirable to include a cable gripping means for loading cable into the connector assembly apparatus 9.

The slotted plates may also be mounted on a motor driven endless belt having speed and index control means, in which case the distance between the plate and the connector assembly station would be determined by the length of the endless belt to enable the apparatus to function in a fully automatic mode.

The measuring apparatus may be used in connection with any suitable connector assembly apparatus. However, one particularly suitable connector assembly apparatus is shown in commonly assigned patent application, Ser. No. 765,604 filed on Aug. 14, 1985 and entitled, "Apparatus For Assembling Two-Piece Connectors".

Having described the preferred embodiments of the invention herein, it should be appreciated that variations may be made thereto without departing from the contemplated scope of the invention. Any suitable means may be used for achieving the desired adjustment of the positioning of the slotted plate, for example, the slotted plate may be mounted for sliding movement relative to the surface of the base member and to be locked thereon in a selected position, or the base member may be mounted for cooperation with a lead screw so that rotation of the lead screw can produce a desired longitudinal movement of the base member relative to the connector assembly station. Accordingly, the embodiments described herein are intended in an illustrative rather than limiting sense, the true scope of the invention being set forth in the claims appended hereto.

I claim:

1. In a connector assembly apparatus, a measurement apparatus for accurately positioning a connected on a cable relative to a previously mounted connector, the apparatus comprising a base member, a slotted plate movably mounted perpendicularly with respect to said base member and being adapted for displacement relative to a connector assembly station , the slot being sized to receive the cable but having a depth less than that of the mounted connector so that the cable can pass freely through the slot until the mounted connector is positioned to abut the slotted plate.

2. Apparatus according to claim 1, wherein guidance means are provided to facilitate insertion of the cable into the slotted plate.

3. Apparatus according to claim 1, wherein a calibrated scale is marked on the base member to give a visual indication of the spacing of the slotted plate from the connector assembly station.

* * * * *